US010794126B2

(12) United States Patent
Magnuson

(10) Patent No.: US 10,794,126 B2
(45) Date of Patent: Oct. 6, 2020

(54) DUAL-ACTIVITY MAST

(71) Applicant: Nabors Drilling Technologies USA, Inc., Houston, TX (US)

(72) Inventor: Christopher Magnuson, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 298 days.

(21) Appl. No.: 15/251,359

(22) Filed: Aug. 30, 2016

(65) Prior Publication Data

US 2018/0058160 A1 Mar. 1, 2018

(51) Int. Cl.

| | |
|---|---|
| ***E21B 19/14*** | (2006.01) |
| ***E21B 7/20*** | (2006.01) |
| ***E21B 19/16*** | (2006.01) |
| ***E21B 19/20*** | (2006.01) |
| ***E21B 19/15*** | (2006.01) |

(52) U.S. Cl.

CPC ..... *E21B 19/14* (2013.01); *E21B 7/20* (2013.01); *E21B 19/155* (2013.01); *E21B 19/16* (2013.01); *E21B 19/20* (2013.01)

(58) Field of Classification Search

CPC ..... E21B 19/14; E21B 19/155; E21B 19/16; E21B 19/20; E21B 7/20

See application file for complete search history.

(56) References Cited

U.S. PATENT DOCUMENTS

| | | | | |
|---|---|---|---|---|
| 4,850,439 | A * | 7/1989 | Lund | E21B 19/20 175/52 |
| 4,962,817 | A | 10/1990 | Jones et al. | |
| 5,503,234 | A | 4/1996 | Clanton | |
| 5,560,435 | A | 10/1996 | Sharp | |
| 6,085,851 | A | 7/2000 | Scott et al. | |
| 6,361,262 | B1 | 3/2002 | Roodenburg | |
| 6,491,477 | B2 | 12/2002 | Bennett, Jr. et al. | |
| 6,763,898 | B1 | 7/2004 | Roodenburg et al. | |
| 7,650,944 | B1 | 1/2010 | Boyle | |
| 7,938,201 | B2 | 5/2011 | Giroux et al. | |
| 7,967,541 | B2 * | 6/2011 | Stroshein | E21B 19/14 414/22.63 |
| 8,162,063 | B2 | 4/2012 | Humphreys | |
| 8,256,520 | B2 | 9/2012 | Lucas et al. | |

(Continued)

FOREIGN PATENT DOCUMENTS

| | | |
|---|---|---|
| WO | WO2008/103156 A2 | 8/2008 |
| WO | WO2014/116697 A1 | 7/2014 |
| WO | WO 2015-050877 A1 | 4/2015 |

OTHER PUBLICATIONS

Canada Office Action dated Jun. 26, 2018, Application No. 2,975,834, 7 pages.

*Primary Examiner* — Caroline N Butcher

(74) *Attorney, Agent, or Firm* — Haynes and Boone, LLP

(57) ABSTRACT

Systems and methods for operating a land-based drilling rig apparatus include a dual-activity mast having a first fingerboard supported by the mast and disposed on a first side of the well center bore, and include a second fingerboard supported by the mast and disposed on a second side of the well center bore. The first and second fingerboards may permit simultaneous operations, such as tripping and casing stand assembly.

16 Claims, 9 Drawing Sheets

(56) References Cited

U.S. PATENT DOCUMENTS

| | | | | |
|---|---|---|---|---|
| 8,342,249 | B2 | 1/2013 | Payne | |
| 8,381,480 | B2 | 2/2013 | Vogt et al. | |
| 8,733,472 | B2 | 5/2014 | Magnuson | |
| 8,911,179 | B2 | 12/2014 | Noble et al. | |
| 9,051,782 | B2 | 6/2015 | Magnuson | |
| 9,354,623 | B2 | 5/2016 | Magnuson | |
| 9,394,751 | B2 | 7/2016 | Magnuson | |
| 9,551,196 | B2 | 1/2017 | Layden | |
| 9,932,785 | B2 | 4/2018 | Frith et al. | |
| 2008/0202812 | A1* | 8/2008 | Childers | E21B 19/20 175/52 |
| 2010/0176079 | A1 | 7/2010 | Lucas et al. | |
| 2010/0303586 | A1 | 12/2010 | Hankins et al. | |
| 2011/0302869 | A1 | 12/2011 | Vogt et al. | |
| 2012/0055678 | A1 | 3/2012 | Humphreys | |
| 2013/0101357 | A1 | 4/2013 | Noble et al. | |
| 2013/0284450 | A1 | 10/2013 | Roodenburg et al. | |
| 2014/0202769 | A1 | 7/2014 | Magnuson | |
| 2015/0086718 | A1 | 3/2015 | Magnuson et al. | |
| 2015/0090463 | A1 | 4/2015 | Gupta et al. | |
| 2015/0096764 | A1 | 4/2015 | Magnuson et al. | |
| 2015/0101826 | A1 | 4/2015 | Gupta et al. | |
| 2015/0330162 | A1 | 11/2015 | Magnuson et al. | |
| 2016/0060979 | A1 | 3/2016 | Magnuson | |
| 2016/0060982 | A1 | 3/2016 | Layden | |
| 2016/0090794 | A1 | 3/2016 | Holck | |
| 2016/0018928 | A1 | 6/2016 | Magnuson | |
| 2016/0153251 | A1 | 6/2016 | Frith et al. | |
| 2016/0168929 | A1 | 6/2016 | Magnuson et al. | |
| 2016/0251869 | A1 | 9/2016 | Deel et al. | |
| 2017/0009538 | A1 | 1/2017 | Layden | |
| 2017/0101826 | A1 | 4/2017 | Sigmar et al. | |
| 2017/0152713 | A1 | 6/2017 | Dowdy et al. | |
| 2018/0058160 | A1 | 3/2018 | Magnuson | |
| 2018/0135360 | A1 | 5/2018 | Holck | |
| 2018/0155995 | A1 | 6/2018 | Van der Hoorn et al. | |

* cited by examiner

DUAL-ACTIVITY MAST

TECHNICAL FIELD

The present description relates in general to systems and methods for performing dual drilling functions on a land-based mobile drilling rig. More specifically, the present disclosure relates to systems and methods that include a dual-activity mast that permits dual drilling functions on a land-based mobile drilling rig.

BACKGROUND

The rise in cost for exploration and production of hydrocarbons has been a driving force for improved efficiencies in drilling operations. Current costs for the actual drilling of a well has increased over the past 10 years; gaining a greater percentage of the total cost of the well.

In drilling operations, casing is inserted into a borehole at periodic intervals as the borehole is drilled. Each time another stand of casing is lowered into the borehole, the drill string is tripped out of the borehole, and a stand of casing is assembled from casing tubulars for insertion. As the drill string is tripped out of the borehole it is broken down into stands and set aside, for example in a fingerboard. After the casing is inserted into the borehole, the drill string is reassembled and tripped back into the borehole.

Conventional casing operations do not occur until the drilling rig has completed tripping out of the hole. That is, currently drilling and casing operations cannot occur simultaneously on land-based mobile drilling rigs due to the limited size of the drill floor and use of a standard mast with racking board for mobile rigs. The use of offline or safe zone stand building does not readily allow for dual activity within the existing well floor.

Recent inventions and development of automated racking operations for mobile rigs and small platform rigs open a new opportunity for increased efficiency in drilling operations. The present disclosure addresses one or more of these or other deficiencies in the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
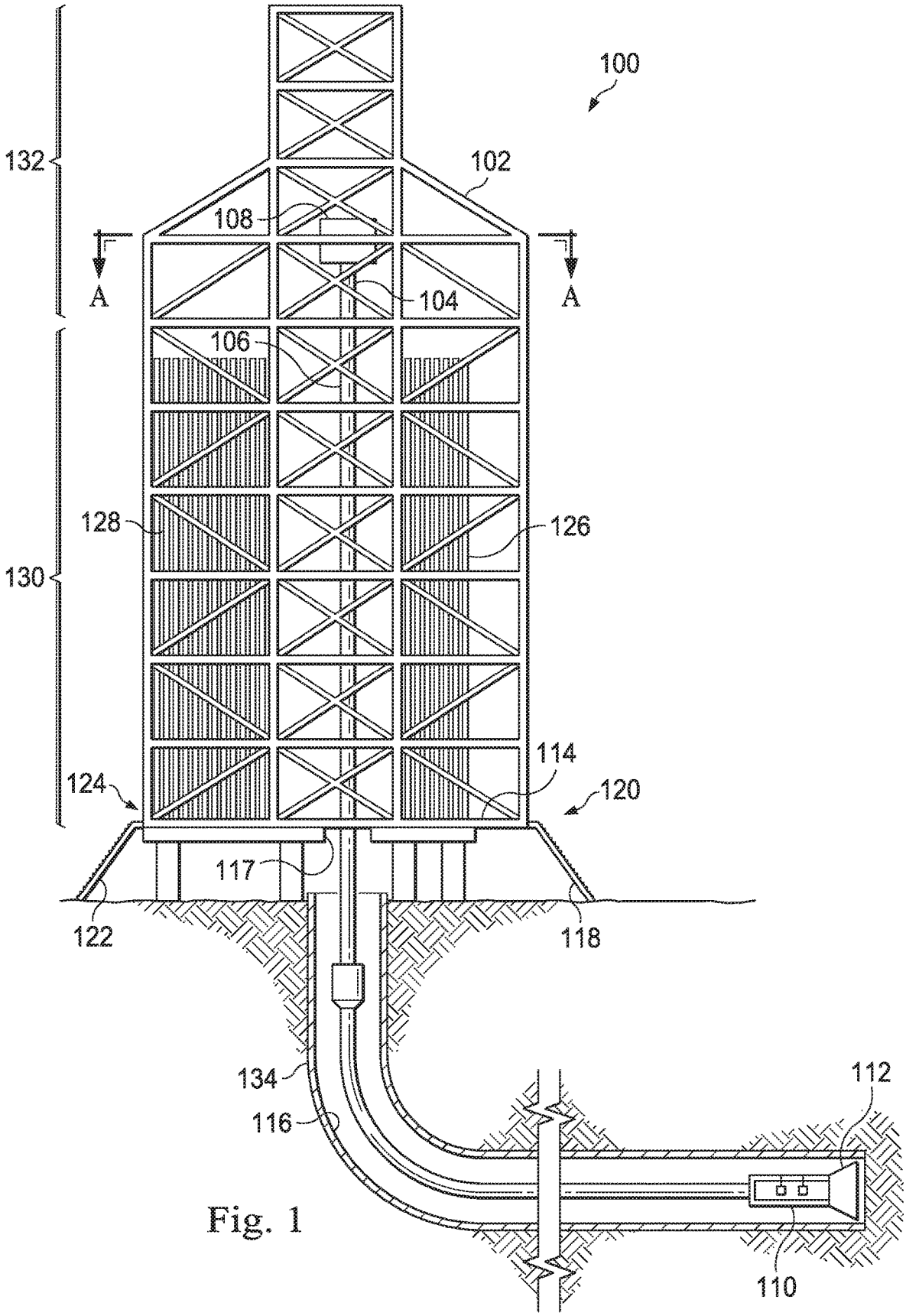
FIG. 1 is a diagram of a mobile land based drilling rig and a wellbore according to various aspects of the disclosure.

It is to be understood that the following disclosure provides many different implementations, or examples, for implementing different features of various implementations. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed. Moreover, the formation of a first feature over or on a second feature in the description that follows may include implementations in which the first and second features are formed in direct contact, and may also include implementations in which additional features may be formed interposing the first and second features, such that the first and second features may not be in direct contact.

The systems and methods described herein may allow users to perform dual drilling processes to simultaneous occur on mobile land based drilling rigs. For example, the systems and method described herein may utilize a dual-activity mast that permits dual activities to occur simultaneously. In some implementations, at least one of these dual activities is an offline activity, such as building or breaking down casing stands, building or breaking down drill pipe stands, or loading and offloading tubulars. The offline activity may occur simultaneously with another offline activity or with an online activity, such as a tripping operation. In one example, casing crews can begin to assemble stands of casing while the drilling rig is tripping out of the hole in anticipation of casing operations. To accomplish this, the dual-activity mast may include dual racking boards and setbacks along with an open access to well center from multiple sides of well center. In some implementations, the dual racking boards are located on opposing sides of the well center. Thus, while the drill pipe being tripped from well center is removed from the string and placed in a first racking board, casing stands may be made up and placed in a second racking board. While the disclosure may be directed to casing stand building and tripping out of a hole being simultaneously performed, other implementations include simultaneous performance of other drilling operations. For example, some other drilling activities that can be simultaneously performed include making up casing stands while drilling, making up casing stands while tripping, making up casing stands while making up drill pipe stands, casing a hole while making up pipe stands, casing a hole while breaking down drill pipe stands, and other activities.

The dual-activity mast described herein may enable higher efficiency drilling processes to occur. In some implementations, casing crews can utilize automated tracking systems for the building of casing stands, simultaneously with tripping drill pipe out of the hole. This process may increase drilling efficiencies by reducing the number of connections needed for the casing during the time that casing is introduced to the hole. In addition, this process may increase drilling efficiencies by providing a better method for the manipulation of casing stands and drill pipe stands during activities.

In some implementations, the drilling rig and dual-activity mast described herein may include two vertical V doors at least 100 feet tall with two separate racking boards integrated with two setbacks located on opposite sides of well center. Each of these setback and racking systems may permit independent operation and handling for drill pipe tubulars and for casing tubulars.

FIG. 1 illustrates an example drilling rig 100 according to an exemplary implementation. In this implementation, the drilling rig 100 includes a dual-activity mast 102 that supports a drill string 104. The drill string 104 may be comprised of drill pipe 106 that is connected to a top drive 108 and may terminate in a bottom hole assembly (BHA) 110, which includes a drill bit 112. The top drive 108 may be attached to the dual-activity mast 102 by top drive guide tracks (shown in FIG. 3). In some implementations, the drill string 104 may include one or more subs or other components. The drill pipe 106 may be comprised of tubular stands that are assembled on a drill floor 114 before being lowered into a wellbore 116 through a well center bore 117 in the drill floor 114. In some implementations, the drill floor 114 may be sized in a range of about 35×35 feet, although larger and smaller drill floors are contemplated. In some implementations, the drilling rig 100 may have a drill floor 114 sized less than approximately 1600 square feet. In other implementations, the drilling rig 100 may have a drill floor size of less than approximately 1200 square feet. In some implementations, the drilling rig 100 may be a mobile, land-based drilling rig.

In the implementation shown, the drill floor 114 may be raised above ground level, and may be accessible by a pair of catwalks 118 and 122. The first catwalk 118 may connect to a first side of the drill floor 114 at a first v-door 120. The second catwalk 122 may connect to a second side of the drill floor 114 at a second v-door 124. In some implementations, catwalks 118 and 122 connect to the drill floor 114 on opposite sides of drill floor 114, allowing users to introduce materials to the drill floor 114 from either side of the drilling rig 100. For example, a first set of tubulars (e.g., drill pipe tubulars) may be introduced to or removed from the drill floor 114 via the first catwalk 118, and a second set of tubulars (e.g., casing tubulars) may be introduced to or removed from the drill floor 114 via the second catwalk 122. In this way, v-doors and setbacks may be accessed on opposite sides of well center bore 117 and equipment may be introduced to or removed from each work space without having to cross well center bore 117. While shown in FIG. 3 with workspaces and the doors on opposing sides of the well center bore 117, some implementations have V doors on adjacent sides of the drill floor 114.

In some implementations, the dual-activity mast 102 may be modular and comprised of multiple segments. For example, the dual-activity mast 102 may include a leg segment 130 and an upper segment 132. In some implementations, segments 130 and 132 may each be formed of further sub-segments, allowing the dual-activity mast 102 to break down into smaller pieces, as further described below with reference to FIG. 2. For example, leg segment 130 may be formed of two or more sub-segments that may be assembled when constructing the dual-activity mast 102. In some implementations, the leg segment 130 may be connected to the drill floor 114 by hinges (not shown) that allow the leg segment 130 to be folded down. Upper segment 132 may similarly be connected to the leg segment 130 by hinges (not shown) to allow the upper segment 132 to also fold for disassembly and transportation. When assembled, segments 130 and 132 may be connected to each other and to the drill floor 114 by bolts or other suitable fasteners. Such a modular dual-activity mast 102 may be advantageous because it may allow for a more compact form factor during movement of the drilling rig 100 to another drilling location, a storage location, or the like.

At periodic intervals during drilling, casing may be introduced into the wellbore 116 to stabilize the structure of the bore hole. This may occur at any stage of drilling, including during vertical, curved, or horizontal sections. Casing 134 may be formed of large diameter tubulars that may be held in place with cement poured between the casing and the wall of the wellbore 116. The casing 134 may provide various benefits to the wellbore, such as preventing the wellbore 116 from collapse, providing support for high pressure introduction of fluid to the wellbore 116, and providing a smooth bore hole for the drill string 104 to navigate, which may be particularly important as the length of the wellbore 116 grows.

Figure 2:
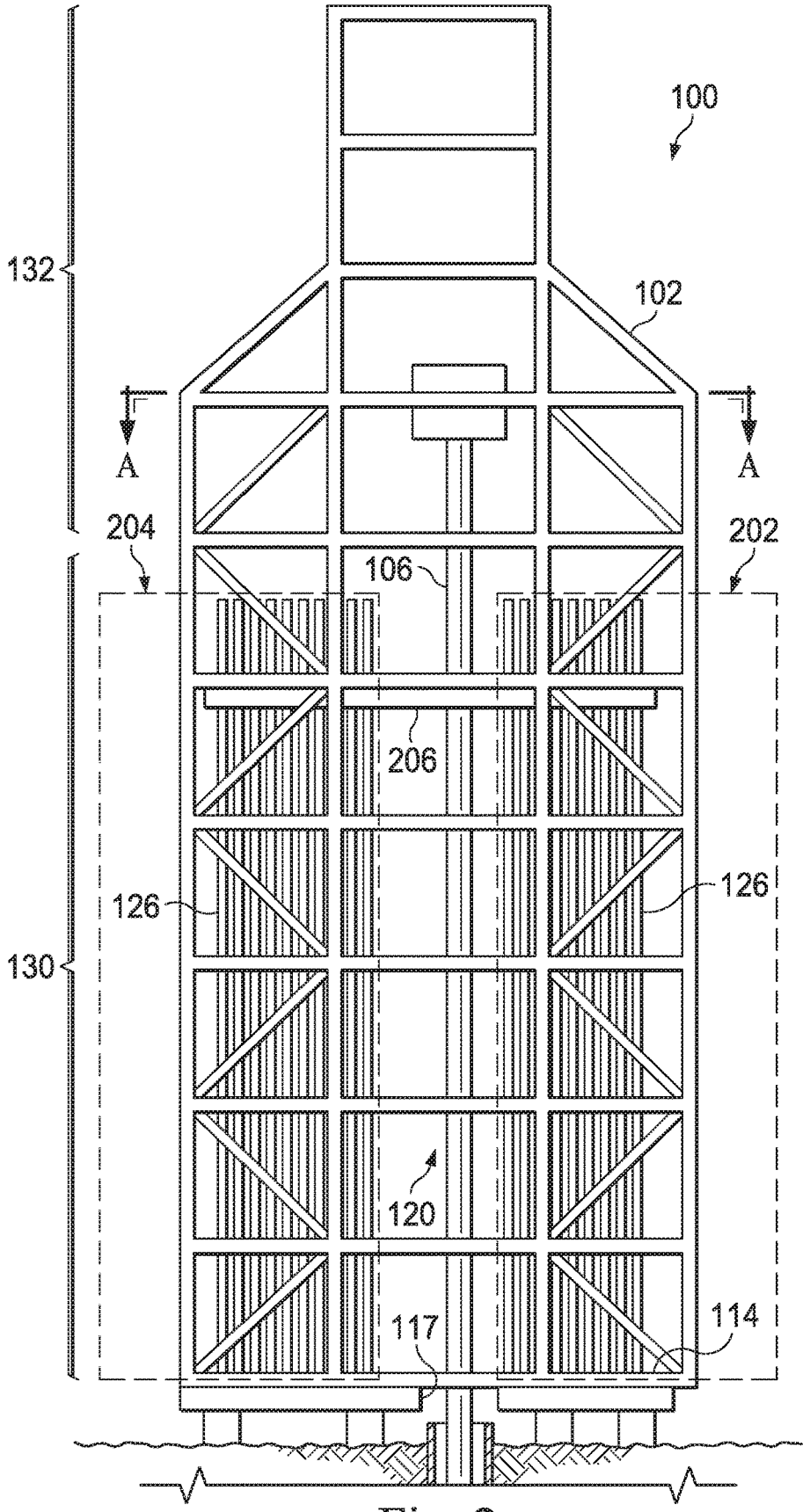
FIG. 2 is a side view of the drilling rig of FIG. 1.

FIG. 2 shows a side view of the drilling rig 100 and the dual-activity mast 102. From this perspective, the v-door 120 is visible. The opposite side of rig 100, where v-door 124 is located, may be substantially similar to the side shown in FIG. 2. As discussed above, leg segment 130 may be composed of further segments, for example sub-segments 202 and 204. Breaking the leg segment 130 down into smaller segments such as sub-segments 202 and 204 may allow the drilling rig 100 to collapse to a smaller form factor, increasing mobility of the drilling rig 100.

As can be seen with reference to FIG. 2, the drill pipe stands 126 may be stored in each side of the v-door 120. As would be understood to one of ordinary skill in the art, stands may be formed of one more drill pipe tubulars. Casing stands may be disposed on the opposing side of the drilling rig, not visible in the view shown in FIG. 2. A fingerboard 206 may be attached to the dual-activity mast 102 above the drill floor 114 to support the drill pipe stands 126. A separate fingerboard may be attached to the dual-activity mast 102 above the drill floor 114 to support the casing stands, not visible in FIG. 2. The fingerboard 206 may be used to store drill pipe stands 126 in the dual-activity mast 102, and may allow for ease of access to the stands when assembling sections of drill pipe or casing for insertion into the wellbore 116. Storage of drill pipe stands in the fingerboard 206 may provide various benefits not obtained when storing the stands off of the drilling rig 100. For example, drill pipe stands on the drilling rig are readily accessible for use, creating efficiencies not obtained if the stands were brought onto the drill floor 114 from outside the drilling rig 100 as they are needed or at the time they are to be introduced to well center. In some implementations, an automated racking device may operate on the drill floor 114 to assist with racking and removing stands from the fingerboard 206 and may assist users in making up stands and breaking down stands into individual tubulars.

Figure 3:
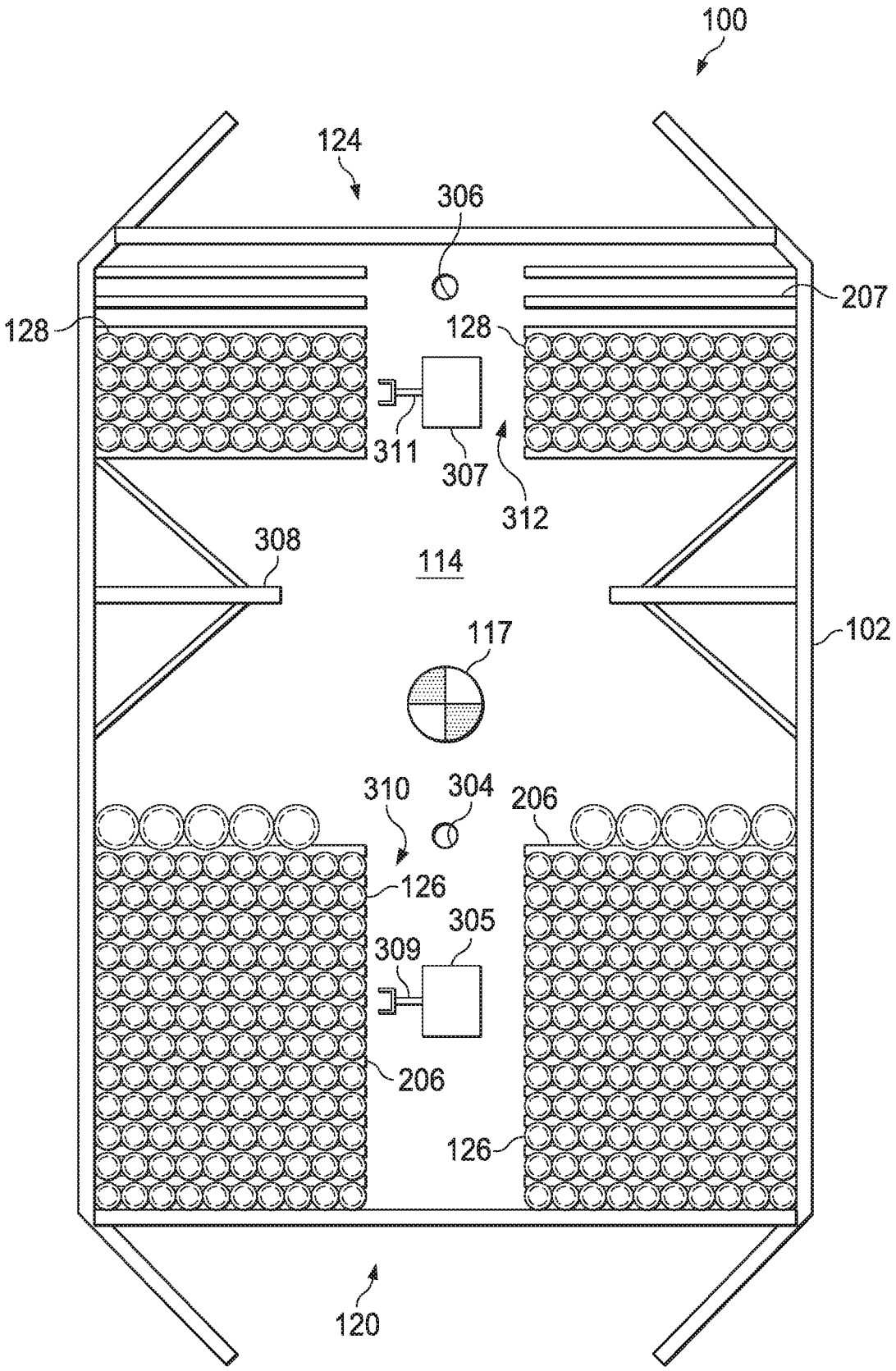
FIG. 3 is a top view showing a part of the drilling rig of FIGS. 1 and 2.

FIG. 3 shows a top cross-sectional view of the drilling rig 100 of FIGS. 1 and 2 along line A-A. FIG. 3 shows that in addition to fingerboard 206, the dual-activity mast also includes a fingerboard 207. That is, from this perspective, both fingerboard 206 (which holds drill pipe stands 126) and fingerboard 207 are visible. In some implementations, fingerboard 207 supports casing stands 128 vertically disposed on drill floor 114. The casing stands may be formed of one or more casing tubulars. In some implementations, the casing stands comprise three casing tubulars and have a length between about ninety and one-hundred feet. Other lengths of stands are contemplated. Fingerboard 207 may be positioned on the opposite side of well center bore 117 from fingerboard 206, or in any other position within dual-activity mast 102 that allows for casing stands 128 to be accessible without interfering with the make-up and breakdown of drill pipe stands 126 or introduction or removal of the stands into the well center.

A drill pipe mousehole 304 in drill floor 114 is also visible from this perspective. The drill pipe mousehole 304 is in the drill floor 114 is sized to allow drill pipe tubulars and drill pipe stands 126 to pass through. The drill pipe mousehole 304 may be used in the assembly and disassembly of drill pipe tubulars into drill pipe stands 126. For example, during assembly of drill pipe stands, a drill pipe tubular may be retrieved through the v-door 120 or the fingerboard 206 and lowered into the drill pipe mousehole 304 for connection to other drill pipe tubulars to create drill pipe stands 126. Some implementations employ a racking device 305 to manipulate the tubulars and the stands and to introduce the stands 126 to the fingerboard 206 or to the well center bore 117. In other examples, during disassembly of the drill pipe stands 126, a stand may be introduced into drill pipe mousehole 304 so that the stand can be broken down into tubulars. The drill pipe stand 126 may then be lifted out of the drill pipe mousehole 304 and introduced into a fingerboard 206 for later use or if breaking down, the tubulars may be removed from the drilling rig 100. The drill floor 114 may also have a drill pipe setback area 310. The drill pipe setback area 310 provides an area for drill pipe tubulars to be moved from laying down, or a more horizontal condition to upright, e.g., with the racking device 305.

In some implementations, the racking device 305 may be an automatic racking device used to lift the drill pipe tubulars and stands 126 into and out of the drill pipe mousehole 304. In some implementations, the racking device 305 is a column racker that may have one or more arms 309 that are operable to extend and retract and grasp tubulars or stands 126. The arms may be arranged to introduce or remove stands to the fingerboard for presentation to well center, the v-door, or the mousehole. In some implementations, the arms 309 may be able to extend away from racking device 305 to facilitate various actions, as described below. In some implementations, the racking device includes two arms, one arranged to grasp an upper portion or a top portion of a tubular or stand, and another one arranged to grasp a lower portion or bottom of a tubular or stand.

For example, drill pipe tubulars may be introduced to the drill floor 114 through v-door 120 onto setback area 310. As the tubulars are introduced through the v-door 120 into the setback area 310, they may be grasped by an upper arm and brought to an upright position. A lower arm of the racking device may grasp the upright tubular to stabilize it for movement in the upright position. The racking device 305 may rotate and the arms 309 may extend or retract as necessary to position the upright tubular over the drill pipe mousehole 304. The racking device 305 may then lower the tubular into the drill pipe mousehole 304 and return to the v-door 120 to pick up a second drill pipe tubular from the setback area 310 in a similar manner to that described above. In some implementations, the racking device 305 rotates and extends or retracts arms 309 to position the second tubular over the first tubular in the upright position. The first and second tubulars may then be fastened together, for example with the use of an iron roughneck. A third tubular may be picked up from the setback area 310, positioned over the second tubular, and fastened to the second tubular in a similar manner, creating a drill pipe stand 126 comprised of three drill pipe tubulars. Other stands include two tubulars or more than three tubulars. Some stands are single tubular stands. The racking device 305 may then grasp the drill pipe stand 126 with two arms 309 and lift it out of drill pipe mousehole 304. The racking device 305 may then rotate as necessary and extend or retract arms 309 to position the drill pipe stand 126 within fingerboard 206, where the stand is racked for later introduction to the wellbore.

The racking device 305 may also be able to rotate in order to reposition the arms 309. For example, when accepting a tubular through the v-door 120, the racking device 305 may rotate so that arms 309 face towards v-door 120 and are able to grasp the tubular. The racking device 305 may rotate to face the drill pipe mousehole 304 to place a tubular or stand 126 into the mousehole for assembly or disassembly of a stand 126. The racking device 305 may rotate to face fingerboard 206 to rack or retrieve a stand 126. The racking device 305 may rotate to face well center bore 117 in order to introduce or remove stands 126 to well center bore 117.

A casing mousehole 306 in drill floor 114 is also visible in FIG. 3. The casing mousehole 306 is a hole in the drill floor 114 that is sized to allow casing tubulars and casing stands 128 to pass therethrough. The casing mousehole 306 may be used in the assembly of casing tubulars into casing stands 128 for insertion into wellbore 116. For example, during assembly of casing stands 128, a casing tubular may be retrieved from the v-door 124 or fingerboard 207 and lowered into the casing mousehole 306. Some implementations employ lifting equipment such as a racking device 307 to raise, lower, or manipulate the casing tubulars and stands. In some implementations, the racking device 307 may be an automatic racking device, and may have one or more arms 311 to facilitate various actions. The automatic racking device 307 may be similar to automatic racking device 305 described above. The drill floor 114 may also have a casing setback area 312. The casing setback area 312 provides an area for casing tubulars to be manipulated from a more horizontal position to an upright or more vertical position with, for example, racking device 307. The racking device 307 may then place the casing stands in their own fingerboard, separate from the drill pipe fingerboard, but supported on the same mast.

As racking device 307 is separate from racking device 305, casing stands 128 may be assembled in casing mousehole 306 at the same time as drilling processes occur. For example, tripping the drill string in or out of the wellbore 116, assembly and disassembly of drill pipe stands 126 may all occur while casing stands 128 are assembled. Similarly, while casing stands 128 are introduced to wellbore 116, assembly and disassembly of drill pipe stands 126 may occur.

The use of two separate and independent fingerboards may enable these simultaneous operations to occur. For example, while the fingerboard 206 is receiving stands from well center during a tripping operation, the fingerboard 207 may receive stands being made-up in the casing mousehole 306.

Figure 4:
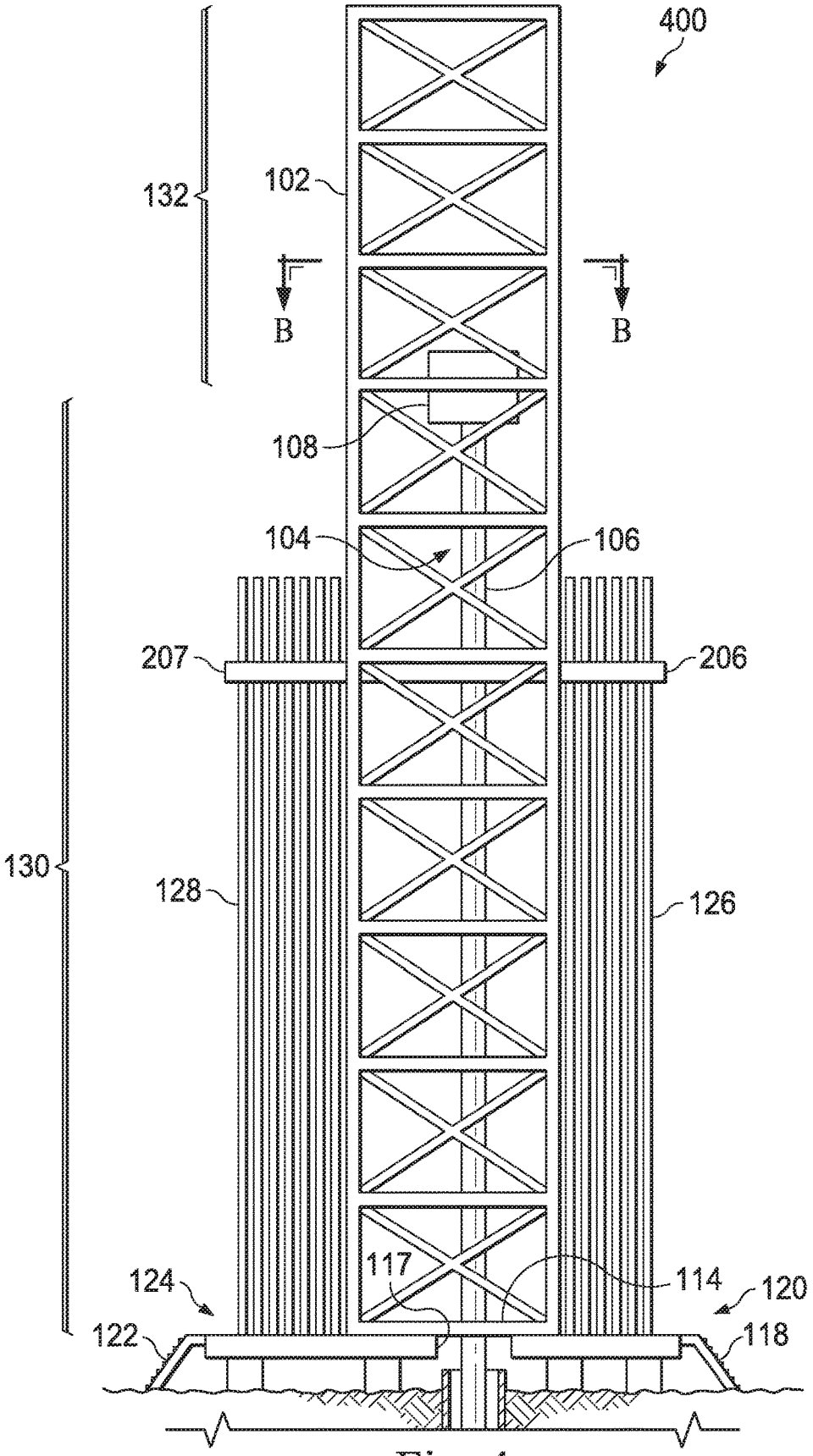
FIG. 4 is a diagram of a mobile land based drilling rig according to various aspects of the disclosure.

In the implementation in FIG. 3, top drive guide tracks 308 are attached to the dual-activity mast 102 and provide support for the top drive 108 (FIG. 1). In some implementations, the top drive guide tracks 308 are gear racks that engage with pinion gears that roll up and down the racks. The top drive 108 may be carried by the pinion gears in the vertical directions. In other implementations, the top drive 108 may be raised or lowered using a crown block and a drawworks. Referring now to FIG. 4, there is shown an alternative implementation of a drilling rig, referenced herein as 400. This implementation may be similar to the drilling rig implementation of FIG. 1 in many respects. As such, many of the reference numbers from other implementations are utilized in the implementation shown in FIG. 4 to indicate similar elements. The drilling rig implementation of FIG. 4 includes fingerboards 206 and 207 located external to the dual-activity mast 102, rather than internal as shown in FIG. 2. Accordingly, the drill pipe stands 126 and casing stands 128 are stored external to the dual-activity mast 102, while still being located on the drilling rig 100. This configuration may reduce the footprint size of the dual-activity mast 102, allowing the dual-activity mast to be more portable. Similar to the dual-activity mast implementation of FIG. 1, the dual-activity mast 102 in FIG. 4 may be comprised of multiple segments such as leg segment 130 and upper segment 132 which allow the dual-activity mast 102 to be disassembled or otherwise collapsed for purposes of mobility to assist when transporting the drilling rig 400 to another drilling location, to a storage location, or the like. Furthermore, the segments 130 and 132 may be comprised of further sub-segments. For example the segment 130 may be formed of sub-segments 202 and 204 as shown in more detail in FIG. 5.

Figure 5:
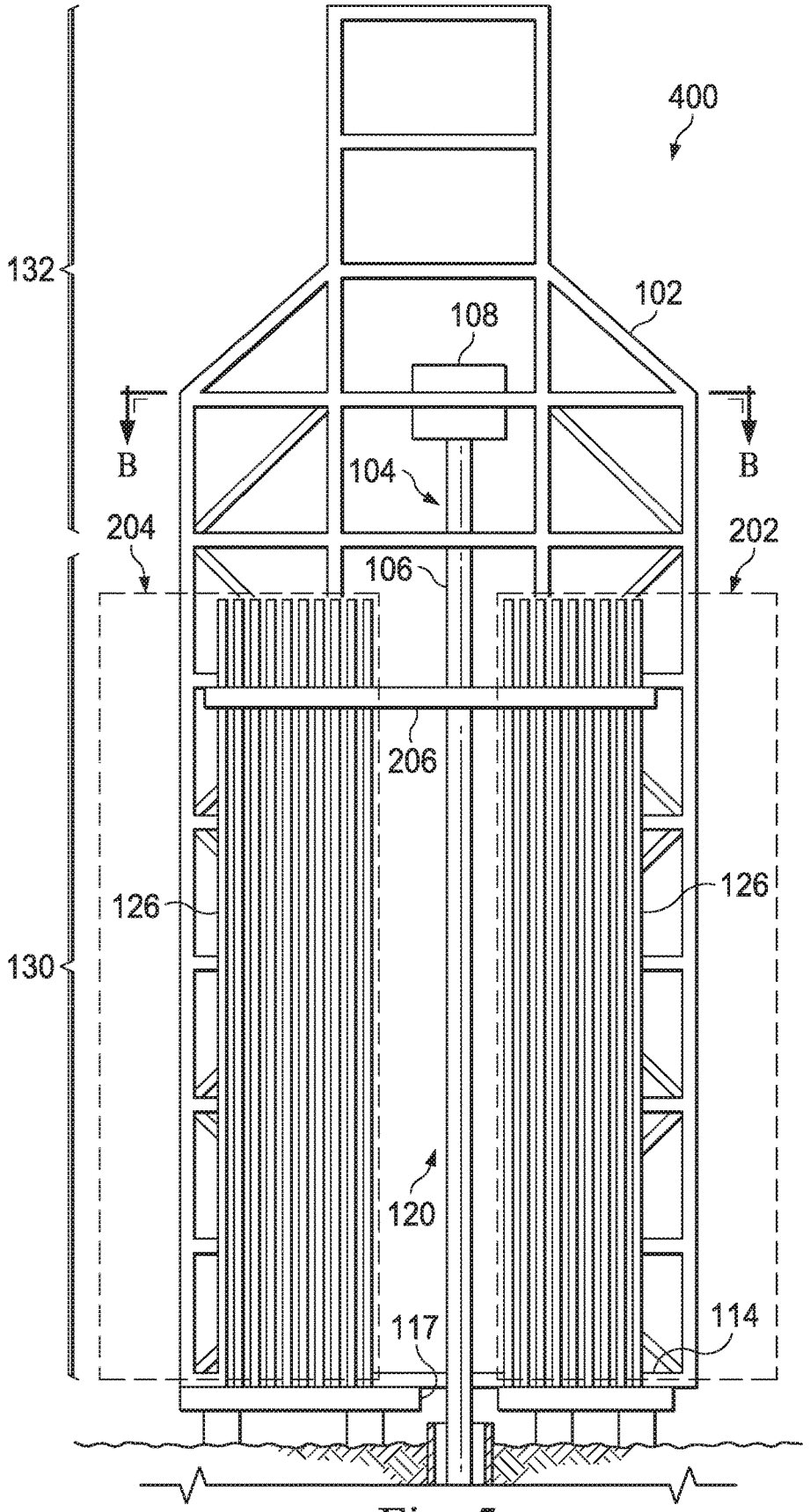
FIG. 5 is a side view of the drilling rig of FIG. 4.

FIG. 5 shows a side view of the drilling rig 400 of FIG. 4. The v-door 120 is visible in FIG. 5. The opposite side of the drilling rig 400, including the v-door 124, may be substantially similar to the side shown in FIG. 5. Accordingly, drill pipe tubulars may be introduced through the v-door 120, while casing tubulars may be introduced through the v-door 124.

Figure 6:
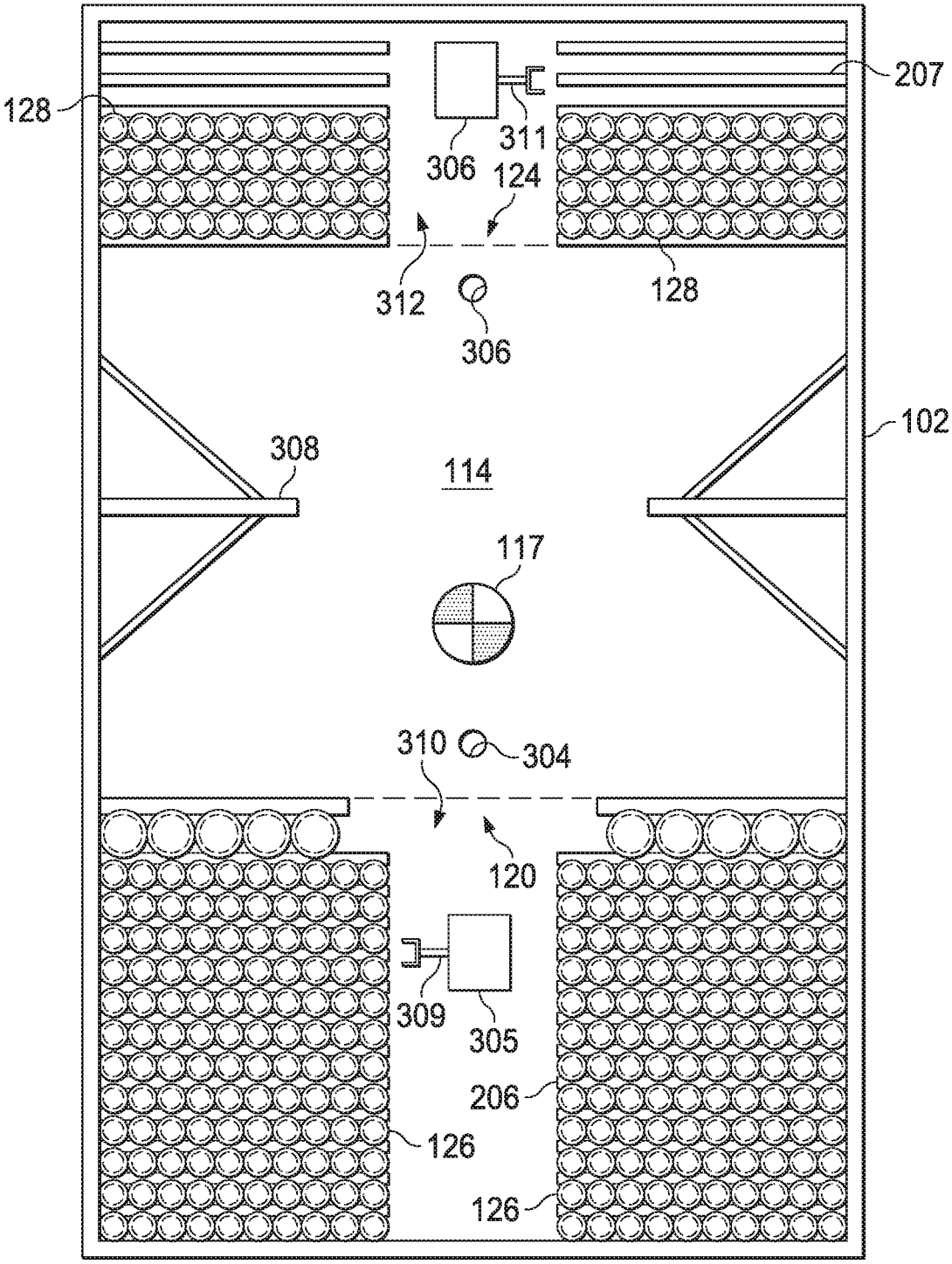
FIG. 6 is a top view showing a part of the drilling rig of FIGS. 4 and 5

In FIG. 5, the drill pipe stands 126 are stored on either side of the v-door 120 so as not to block movement therethrough. The fingerboard 206 is attached to and extends externally from the dual-activity mast 102 above the drill floor 114. The fingerboard 206 is used to store drill pipe stands 126 external to the dual-activity mast 102 on the drilling rig 400, and allows for ease of access to the drill pipe tubulars when assembling sections of drill pipe for insertion into the wellbore 116. Storage of the drill pipe stands 126 on the drilling rig 100 may provide drilling and operational efficiencies not obtained when stands or tubulars are stored off of the drilling rig 400, which would require bringing the tubulars onto the drill floor 114 from outside the drilling rig 400 as they are needed. Furthermore, storage of the drill pipe stands 126 external to the dual-activity mast 102 may provide these benefits while allowing dual-activity mast 102 to have a relatively small footprint on rig 100. A dual-activity mast 102 as shown in FIGS. 4 and 5 may require less material and have a lower cost of manufacture than a dual-activity mast as shown in FIGS. 2 and 3. In addition the dual-activity mast in FIGS. 4 and 5 may be more portable when moving the drilling rig 100 from one drilling location to another, into and out of a storage location, or the like. FIG. 6 shows a top cross-sectional view of the drilling rig 400 of FIGS. 4 and 5 along line B-B in FIG. 5. Unlike FIGS. 4 and 5, FIG. 6 shows racking devices 305, 307 disposed in the setback areas 310, 312. In FIG. 6, both fingerboard 206 (which holds drill pipe stands 126) and fingerboard 207 (which holds casing stands 128) are visible. Fingerboard 207 may be positioned on the opposite side of well center bore 117 from fingerboard 206, or in any other position on rig 100 external to dual-activity mast 102 that allows for casing tubulars to be assembled into casing stands without interfering with the assembly and disassembly of drill pipe stands.

The implementation of FIG. 6 is similar to the implementation of FIG. 3 in many respects. However, here one or both of the drill pipe mousehole 304 and the casing mousehole 306 may be in a different position in the present implementation as compared to the implementation of FIG. 3, so as to be located in the drill floor 114 while still being in a position to assist with make-up or breakdown of drill pipe stands and casing stands, as described above with reference to FIG. 3. Accordingly, the racking devices 305 and 307 may also be located and disposed to travel between the v-door, the fingerboard, and well center, so as to be able to access the drill pipe mousehole 304 and the casing mousehole 306, respectively.

As may be understood from the description herein, the dual-activity mast and drilling rig arrangement simultaneously accommodate the activities of two drilling operations that have conventionally been performed in series. By accommodating two different drilling operations at the same time, efficiencies in drilling rig operations may be achieved. This may result in faster drilling with lower expenses, resulting in a more profitable well. For example, the dual-activity mast may allow casing stands to be made up or broken down at the same time that drill pipe stands may be made up, broken down, tripped in to the well, or tripped out of the well. Likewise, the dual-activity mast may allow drill pipe stands to be made up or broken down at the same time that casing stands may be made up, broken down, or introduced into the well.

Figure 7A:
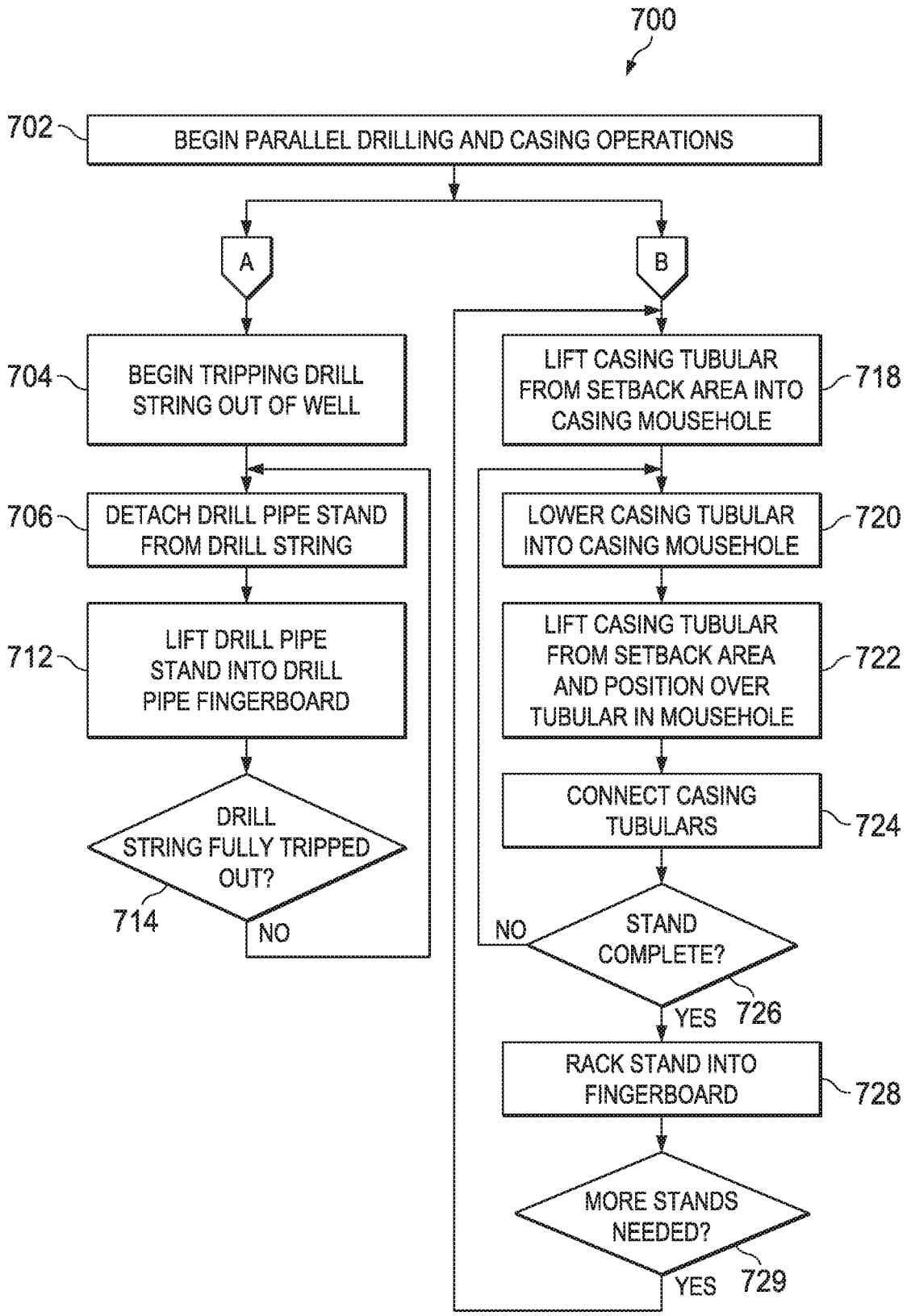
FIG. 7A is a flowchart of an exemplary method for performing dual activities with a dual-activity mast.

FIG. 7A illustrates an exemplary method 700 for performing simultaneous casing and drilling operations using a drilling rig 100 having a dual-activity mast. In this exemplary implementation, the casing operation is assembling casing stands and the drilling operation is tripping the drill string 104 out of the wellbore 116.

The method 700 begins at block 702 where a decision is made to perform simultaneous, or parallel, casing and drilling operations. In this implementation, if casing stands 128 are to be introduced into the wellbore 116, then the casing operation of assembling casing stands 128 may be performed. Simultaneously, the drilling operation of tripping the drill string 104 out of the wellbore 116 may be performed.

As shown in FIG. 7, the method 700 may progress simultaneously along the left and right sides of the method 700, and advances to blocks 704 and 718. Block 704 begins a branch of method 700 wherein the drill string 104 is tripped out of the wellbore 116 and disassembled, while block 718 begins a branch of method 700 wherein casing stands are assembled. For simplicity, the operations of method 700 will be described separately, but at any given time any one of blocks 704-714 may occur simultaneously with any one of blocks 718-729. It is noted that these processes need not begin at the same point in time. For example, in some implementations, the assembly of casing stands 128 may begin well before the drill string begins to be tripped out of the wellbore 116, and so forth.

At 704, an operator begins tripping the drill string 104 out of the wellbore 116. At 706, once the drill string 104 has been raised sufficiently to allow workers to detach the uppermost drill pipe stand 126 from the drill string 104. At block 708, the racking device 305 may lift and carry the drill pipe stand 126 away from well center, and at 712, may rack the drill pipe stand 126 in the fingerboard 206.

At 714, if the drill string 104 is not fully tripped out of wellbore 116, the method 700 returns to block 706, and the method proceeds from that point. In this way, the drill string 104 is disassembled stand by stand until the entire drill string is tripped out of the wellbore. In some implementations, other components such as various subs may also be removed from the drill string 104 as they are tripped out of the well using any appropriate means. Furthermore, BHA 110 and drill bit 112 at the end of drill string 104 may be removed as necessary when the end of drill string 104 is tripped out of the wellbore 116. If at 714 the drill string 104 has been fully tripped out of the wellbore 116, the method 700 ends. At this point, another drilling operation may commence.

Returning to 718, when it is determined that casing is needed in wellbore 116, a casing tubular may be received at the v-door 124 and introduced to the setback area. At 720, the casing tubular may be lowered into casing mousehole 306. In some implementations, equipment such as an automatic racking device 307 may be used to receive the casing tubular through the v-door 124 and to move the casing tubular from the setback area into the casing mousehole 306.

At 722, another casing tubular may be received at the v-door 124 and introduced to the setback area 312. On the drill floor, the casing tubular may be positioned over the casing tubular that is already in the mousehole. The casing tubulars may then be connected at 724, for example, with the aid of an iron roughneck.

At 726, if a casing stand 128 has not been completely made-up, the method returns to block 720 and proceeds from that point to provide an additional casing tubular. In this way, a casing stand 128 may be assembled by attaching casing tubulars to each other and lowering the resultant partial casing stand further into the casing mousehole 306 so that another casing tubular may be added to the top until a casing stand 128 is completed. If at 726 the casing stand 128 has been completed, method 700 progresses to 728.

At 728, the now made-up casing stand 128 is removed, from the casing mousehole 306 and racked into the fingerboard 207. In some implementations, this may be done with the aid of a racking device, such as the racking device 307. The racking device 307 may be an automatic racking device as described above.

At 729, if more casing stands 128 are needed, the method returns to block 718 and assembly of another casing stand 128 proceeds from that point. If no more stands are needed, the method ends. Other casing operations may happen at this point. For example, casing may be introduced to the wellbore 116, for example, if the tripping operation beginning at step 704 has been completed.

Figure 7B:
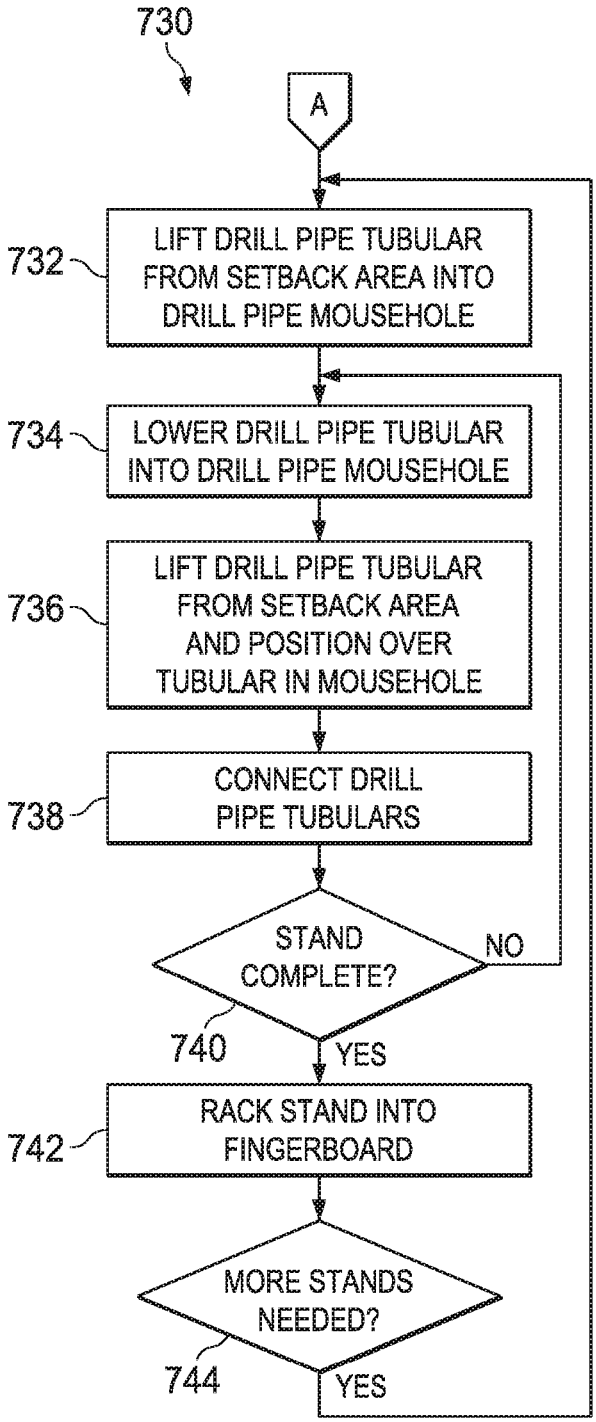
FIG. 7B is a flowchart of an exemplary method for performing dual activities with a dual-activity mast.

FIG. 7B illustrates an exemplary flowchart of a method 730 that may occur as a part of the method in FIG. 7A in place of the tripping out method described at 704, 706, 712, and 714. Accordingly, the method of FIG. 7B may be performed simultaneously with the casing operations shown in FIG. 7A. The drilling operation shown in FIG. 7B is assembling drill pipe stands 126.

Here, the method 730 begins at block A, which corresponds to block A in FIG. 7A. As such, beginning at 702 of method 700 of FIG. 7A, the method 730 moves to block 732 in FIG. 7B. When it is determined that more drill pipe stands 126 need to be assembled, a drill pipe tubular may be introduced through the v-door 120 into the setback area 310. At 734, the drill pipe tubular is lowered into drill pipe mousehole 304. In some implementations, equipment such as an automatic racking device 305 may be used to move the drill pipe tubular into the drill pipe mousehole 304.

At 736, another drill pipe tubular may be introduced through the v-door and moved over the drill pipe tubular that is already in the mousehole. The drill pipe tubular may connected to the tubular that is already in the mousehole. At 738, this may be done, for example, with the aid of an iron roughneck.

At 740, if a drill pipe stand 126 has not been completed, the method 730 returns to block 734 and proceeds from that point. In this way, a drill pipe stand 126 may be assembled by attaching drill pipe tubulars to each other and lowering the resultant partial drill pipe stand further into the drill pipe mousehole 304 so that another drill pipe tubular may be added to the top until a drill pipe stand 126 is completed. If at 740 the drill pipe stand 126 has been completed, method 730 progresses to 742.

At 742, the drill pipe stand 126 may be moved from the drill pipe mousehole 304 and racked into the fingerboard 206. This may be done, for example, with the aid of a racking device 305. The racking device 305 may be an automatic racking device as described above.

At 744, if more drill pipe stands 126 are needed, the method 730 returns to block 732 and assembly of another drill pipe stand 126 may proceed from that point. If no more stands are needed, the method 730 ends. At this point, another drilling operation may commence.

Figure 7C:
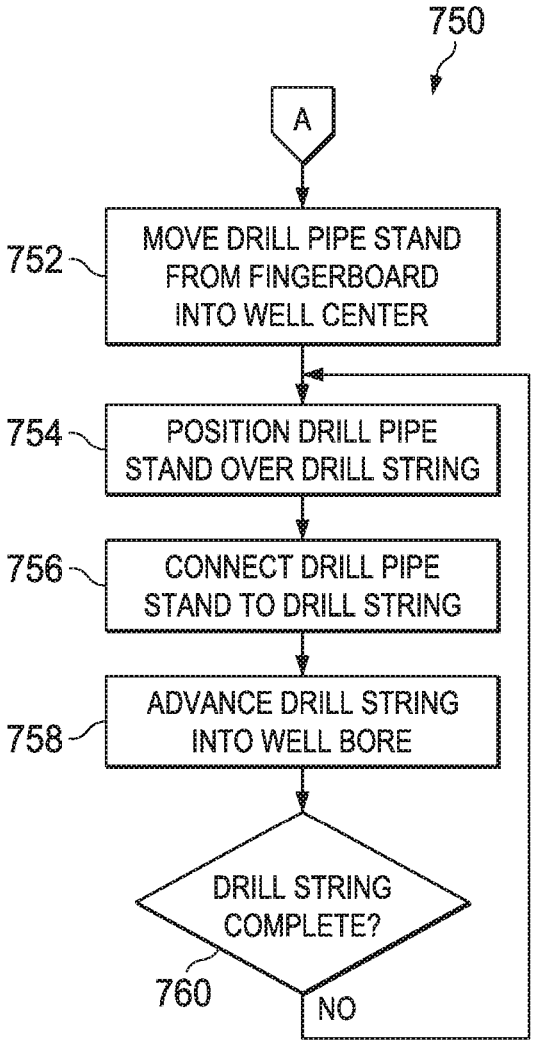
FIG. 7C is a flowchart of an exemplary method for performing dual activities with a dual-activity mast.

FIG. 7C illustrates an exemplary flowchart of a method 750 for performing simultaneous casing and drilling operations using a drilling rig 100 having a dual-activity mast. In FIG. 7C, only a drilling operation is shown, while a casing operation may occur simultaneously, for example the assembly of casing stands of FIG. 7A. The drilling operation shown in FIG. 7C is introducing drill pipe stands 126 to the drill string 104.

The method 750 may be an alternative drilling operation which may be performed in method 700 in place of tripping the drill string 104 out of wellbore 116. Accordingly, the method 750 may replace 704, 706, 712, and 714 of FIG. 7A, beginning at block A.

Beginning from 702 of method 700 of FIG. 7A, the method 750 moves to 752 in FIG. 7C. When it is determined that more drill pipe stands 126 need to be added to drill string 104, a drill pipe stand 126 may be accessed and removed from fingerboard 206 and moved over well center bore 117, for example with the use of a racking device 305 as described above.

At 754, the drill pipe stand 126 is positioned over the drill string 104. At 756, the drill pipe stand is connected to the drill string 104. At 758, the drill string 104, now with an added drill pipe stand 126, is advanced into the wellbore 116.

Moving to decision block 760, if more drill pipe stands 126 need to be added to drill string 104, the method 750 returns to block 754 and proceeds accordingly. If additional drill pipe stands 126 are not need to be added to the drill string 104, the method 750 ends. At this point, another drilling operation may commence.

Figure 7D:
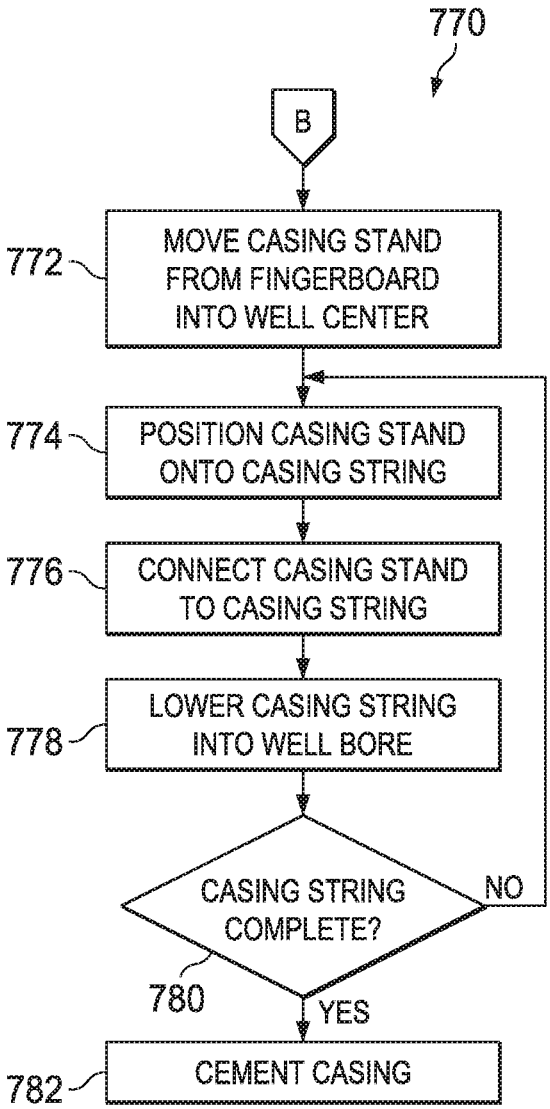
FIG. 7D is a flowchart of an exemplary method for performing dual activities with a dual-activity mast.

FIG. 7D illustrates an exemplary flowchart of a method 770 for performing simultaneous casing and drilling operations using a drilling rig 100 having a dual-activity mast. In FIG. 7D, only a casing operation is shown, while a drilling operation may happen simultaneously, for example the assembly of drill string stands of FIG. 7B. That is, the casing operation shown in FIG. 7D of introducing casing stands 128 to the wellbore 116 may be performed at the same time as the method of FIG. 7B, of building drill pipe stands (or breaking down drill pipe stands.

The method 770 is an alternative casing operation which may be performed in method 700 in place of assembling casing stands 128. Accordingly, the method 770 replaces blocks 718-729 of FIG. 7A, beginning at block B.

Beginning from block 702 of method 700 of FIG. 7A, the method 770 moves to block 772 in FIG. 7D. When it is determined that casing needs to be introduced to the wellbore 116, a casing stand 128 may be removed from fingerboard 207 and moved over well center bore 117, for example with the use of a racking device 307 as described above.

At 774, the casing stand 128 is positioned onto a casing string. In a casing string does not yet exist, the first casing stand 128 begins the casing string. At 776, the casing stand 128 is connected to the casing string.

At 778, the casing string, now with an added casing stand 128, is lowered into the wellbore 116.

At 780, if more casing stands 128 need to be added to casing string, the method 770 returns to block 774 and proceeds accordingly. If no more casing stands 128 need to be added to the casing string, the method 770 moves to 782. At 782, once the casing string is cemented into place to provide casing for the wellbore 116. At this point, another casing operation may commence.

Referring now to all of FIGS. 7A-7D, it is noted that other drilling and casing operations may be performed with the systems of FIGS. 1-6, and that various combinations of drilling and casing operations may be performed simultaneously. However, in some implementations, only one drilling or casing operation may occur over well center bore 117 at any given time.

In view of all of the above and the figures, one of ordinary skill in the art will readily recognize that the present disclosure introduces a land-based drilling rig apparatus that may include a drill floor including a well center bore, a drill pipe mousehole, and a casing mousehole; a dual-activity mast extending above the drill floor; a first fingerboard supported by the dual-activity mast and disposed on a first side of the well center bore; a second fingerboard supported by the dual-activity mast and disposed on a second side of the well center bore, wherein the second side is opposite the first side; a first catwalk on the first side of the well center bore disposed and operative to introduce tubulars to the drill floor; and a first v-door on the drill floor on the first side of the well center bore disposed and operative to receive tubulars to the drill floor from the first catwalk.

In some implementations, the drilling rig apparatus of claim 1 may also include a second catwalk on the second side of the well center bore disposed and operative to introduce tubulars to the drill floor; and a second v-door on the drill floor on the second side of the well center bore disposed and operative to receive tubulars to the drill floor from the second catwalk. In some implementations, the mast comprises a first leg segment, a second leg segment, and an upper segment, and wherein the first and second leg segments are collapsibly attached to the upper segment. In some implementations, the first and second fingerboards are located inside the mast. In some implementations, the first and second fingerboards are located external to the mast. In some implementations, the drill floor is sized less than 1600 square feet. In some implementations, the well center bore is disposed directly between the drill pipe mousehole and the casing mousehole. In some implementations, the drilling rig apparatus may include a first setback area disposed on the first side of the well center bore, below the first fingerboard; and a second setback area disposed on the second side of the well center bore, below the second fingerboard. In some implementations, the mast comprises at least two modular segments. In some implementations, the first fingerboard is arranged to receive drill pipe and the second fingerboard is arranged to receive casing.

The present disclosure also introduces a method, that includes tripping out a plurality of drill pipe stands from a wellbore and introducing the drill pipe stands to a first fingerboard on a first side of a well center bore on a drill floor of a land based drilling rig; and simultaneously assembling a casing stand on a second side of the well center bore and introducing casing stand to a second fingerboard on a second side of the well center bore of the land based drilling rig.

Assembling a casing stand may include placing a first casing tubular in a mousehole in the drill floor; attaching a second casing tubular to the first casing tubular to make-up a casing stand; and removing the casing stand from the mousehole and racking the casing stand in the second fingerboard. In some implementations, placing and removing is performed by an automatic racking device.

The present disclosure also introduces a method, that includes performing a first drilling operation by introducing or removing drill pipe stands into a first fingerboard supported by a dual-activity mast and disposed at a first side of a well center bore on a drill floor of a land based drilling rig; and simultaneously performing a second drilling operation by introducing or removing casing stands into a second fingerboard supported by the dual-activity mast and disposed at a second side of the well center bore on the drill floor of the land based drilling rig. In some implementations, the first drilling operation is one of tripping in, tripping out, tubular stand make-up, or tubular stand breakdown, and wherein the second drilling operation is one of casing stand make up, casing stand breakdown, or introducing casing stands to well center bore.

The present disclosure also introduces a drilling rig apparatus that may include a drill floor including: a well center bore; a drill pipe mousehole; a casing mousehole. The drilling rig apparatus may also include a dual-activity mast disposed above the drill floor; a first fingerboard supported by the dual-activity mast and disposed on a first side of the well center bore; a first setback area disposed on the first side of the well center bore; a second fingerboard supported by the mast and disposed on a second side of the well center bore, wherein the second side is opposite the first side; and a second setback area disposed on the second side of the well center bore.

In some implementations, the dual-activity mast comprises a first leg segment, a second leg segment, and an upper segment, and wherein the first and second leg segments are collapsibly attached to the upper segment. In some implementations, the first and the second fingerboards are located inside the dual-activity mast. In some implementations, the first and the second fingerboards are located external to the dual-activity mast. In some implementations, the dual-activity mast may include a first v-door providing access to the first fingerboard and a second v-door providing access to the second v-door.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method, comprising:

tripping out a plurality of drill pipe stands from a well center bore on a drill floor of a land based drilling rig and, with a first racking device disposed above a first portion of the drill floor on a first side of the well center bore, introducing the drill pipe stands to a first fingerboard on the first side of the well center bore; and simultaneously assembling, with a second racking device disposed above a second portion of the drill floor on a second side of the well center bore opposite the first side, a casing stand with the use of a casing mousehole on the second side of the well center bore and introducing the casing stand to a second fingerboard, wherein the first and second portions of the drill floor are on opposite sides of the well center bore and aligned with the well center bore, wherein the second racking device is disposed between the casing mousehole and the well center bore, wherein the second fingerboard is disposed on the second side of the well center bore of the land based drilling rig such that assembly of the casing stand does not physically interfere with the tripping out of the plurality of drill pipe stands.

2. The method of claim 1, wherein assembling the casing stand comprises:

while tripping out the plurality of drill pipe stands, placing a first casing tubular in the casing mousehole in the drill floor;

attaching a second casing tubular to the first casing tubular to make-up a casing stand; and removing the casing stand from the casing mousehole and racking the casing stand in the second fingerboard.

3. The method of claim 2, wherein the first and second racking devices are automatic racking devices.

4. A method, comprising:

performing a first drilling operation with a first racking device above a first portion of a drill floor of a land based drilling rig by introducing or removing drill pipe stands into a first fingerboard supported by a mast and disposed at a first side of a well center bore on the drill floor of the land based drilling rig; and simultaneously performing a second drilling operation with a second racking device above a second portion of the drill floor by introducing or removing casing stands into a second fingerboard supported by the mast and disposed at a second side of the well center bore on the drill floor of the land based drilling rig, wherein the first and second portions of the drill floor are on opposite sides of a well center bore and aligned with the well center bore, wherein the second side is opposite the first side with respect to the well center bore such that the well center bore extends beneath the mast and directly between the first racking device and the first fingerboard, and the second racking device and the second fingerboard, respectively.

5. The method of claim 4, wherein the first drilling operation is one of tripping in, tripping out, tubular stand make-up, or tubular stand breakdown, and wherein the second drilling operation is one of casing stand make up, casing stand breakdown, or introducing casing stands to well center bore.

6. The method of claim 4, wherein the first drilling operation comprises placing drill pipe tubulars on a drill pipe catwalk and introducing drill pipe tubulars through a first v-door from the drill pipe catwalk on the land based drilling rig; and wherein the second drilling operation comprises placing casing tubulars on a casing catwalk and introducing casing tubulars through a second v-door from the casing catwalk on the land based drilling rig.

7. The method of claim 4, wherein the first drilling operation comprises an online activity comprising tripping in or tripping out the drill pipe stands, and wherein the second drilling operation comprises an offline assembly activity comprising making up or breaking down the casing stands.

8. The method of claim 7, wherein the first drilling operation comprises tripping out the drill pipe stands and wherein the second drilling operation comprises making up casing stands; and further comprising performing a third drilling operation after the second drilling operation is complete to introduce the made up casing stands to the well center bore.

9. A method comprising:

receiving, with a first fingerboard supported by a mast and disposed on a first side of a well center bore of a land based drilling rig, from a first racking device disposed above a first portion of a drill floor, tubulars during a first drilling operation; and receiving, with a second fingerboard supported by the mast and disposed on a second side of the well center bore opposite the first side with respect to the well center bore such that the well center bore extends beneath a central portion of the mast that is disposed directly between the first and second fingerboards, from a second racking device disposed above a second portion of the drill floor, casing during a second drilling operation, wherein the first and second portions of the drill floor are on opposite sides of the well center bore and aligned with the well center bore, wherein the first and second drilling operations are performed simultaneously.

10. The method of claim 9, wherein the first drilling operation is one of tripping out, tubular stand make-up, or tubular stand breakdown, and wherein the second drilling operation is one of casing stand make up, casing stand breakdown, or introducing casing stands to the well center bore.

11. The method of claim 9, further comprising performing at least one of the first and second drilling operations with an automatic racking device.

12. The method of claim 9, further comprising performing at least one of the first and second drilling operations with a column racker.

13. The method of claim 9, wherein the first drilling operation comprises receiving tubulars from the well center bore, and wherein the second drilling operation comprises receiving casing from a mousehole.

14. The method of claim 9, further comprising assembling casing stands at a same time as the step for receiving the tubulars.

15. The method of claim 14, wherein the assembling the casing stands comprises:

placing a first casing tubular in a mousehole in a drill floor of the land based drilling rig;

attaching a second casing tubular to the first casing tubular to make-up a casing stand; and removing the casing stand from the mousehole and racking the casing stand in the second fingerboard.

16. The method of claim 9, further comprising detaching tubulars at a same time as the step for receiving the casing.

* * * * *